United States Patent [19]

Negishi

[11] 3,995,497

[45] Dec. 7, 1976

[54] APPARATUS FOR PREVENTING DEFECTIVE PACKING OF CIGARETS

[75] Inventor: Yoshio Negishi, Gyoda, Japan

[73] Assignee: Showa Manufacturing Co., Ltd., Tokyo, Japan

[22] Filed: Dec. 16, 1975

[21] Appl. No.: 641,233

[52] U.S. Cl. ..... 73/432 R; 53/62

[51] Int. Cl.[2] ..... B65B 63/00

[58] Field of Search ..... 53/61, 62; 73/432 R

[56] References Cited

FOREIGN PATENTS OR APPLICATIONS 1,043,368 9/1966 United Kingdom ..... 53/62

*Primary Examiner*—Donald O. Woodiel
*Attorney, Agent, or Firm*—A. W. Breiner

[57] ABSTRACT

An apparatus for preventing defective packing of cigarets wherein a presser which moves a plurality of cigarets arranged on two or three steps so as to be packed at a fixed velocity in the lengthwise direction of the cigarets along a frame is provided, a plurality of contact arms opposed to the respective cigarets arranged on the uppermost step are respectively independently rotatably supported on a shaft arranged above and at right angles with the frame, each contact arm is fitted with a shielding plate at the upper end and with a roller at the lower end so as to be suspended by the self-weight of the roller and to be pressed to rotate by the cigaret on the upper step with which it contacts, on the other hand, a sensing lever rotated by a supporting shaft is projected at right angles with the advancing direction of the cigarets on the side of the lower step of the cigarets so as to rotate clockwise and anticlockwise against a spring and to be pressed to rotate by the side of the cigarets with which it contacts and a shielding plate is fitted to the supporting shaft so as to normally intercept a beam from a projector and to open the beam when rotated.

5 Claims, 3 Drawing Figures

APPARATUS FOR PREVENTING DEFECTIVE PACKING OF CIGARETS

This invention relates to apparatus for preventing defective packing of cigarets to be moved as arranged so as to be packed.

As this kind of apparatus, there is already taken a so-called contact point system wherein any defective packing of cigarets is detected with a detecting needle for the entire dimensions of the cigarets and a switch or the like operatively connected with it. However, there has been a defect that, when the arrangement is bad as in the case that, for example, one intermediate cigaret is diagonally arranged, even if the number of the cigarets lacks, it will not be able to be detected. Further, in the contact point system, a fine powder or dust will be deposited on the contact point to impair the passage of electricity and to be likely to cause mis-sensing. Therefore, it has been necessary to remove the defective contact of the contact point and to periodically inspect the contact point.

An object of the present invention is to provide an apparatus for preventing defective packing of cigarets wherein such conventional defects are eliminated, the contact point system is converted to a photoelectric cell system, a plurality of cigarets arrange so as to be packed, that is, on two or three steps are moved at a fixed velocity in the lengthwise direction of the cigarets along a frame and a plurality of contact arms opposed to the respective cigarets arranged on the uppermost step and a sensing lever projected from the side of the cigarets arranged on the lower step are respectively rotatably held so that the contact arms and sensing lever may rotate with the contact with the cigarets and a beam from a projector normally intercepted with a shielding plate may be opened.

Figure 1:
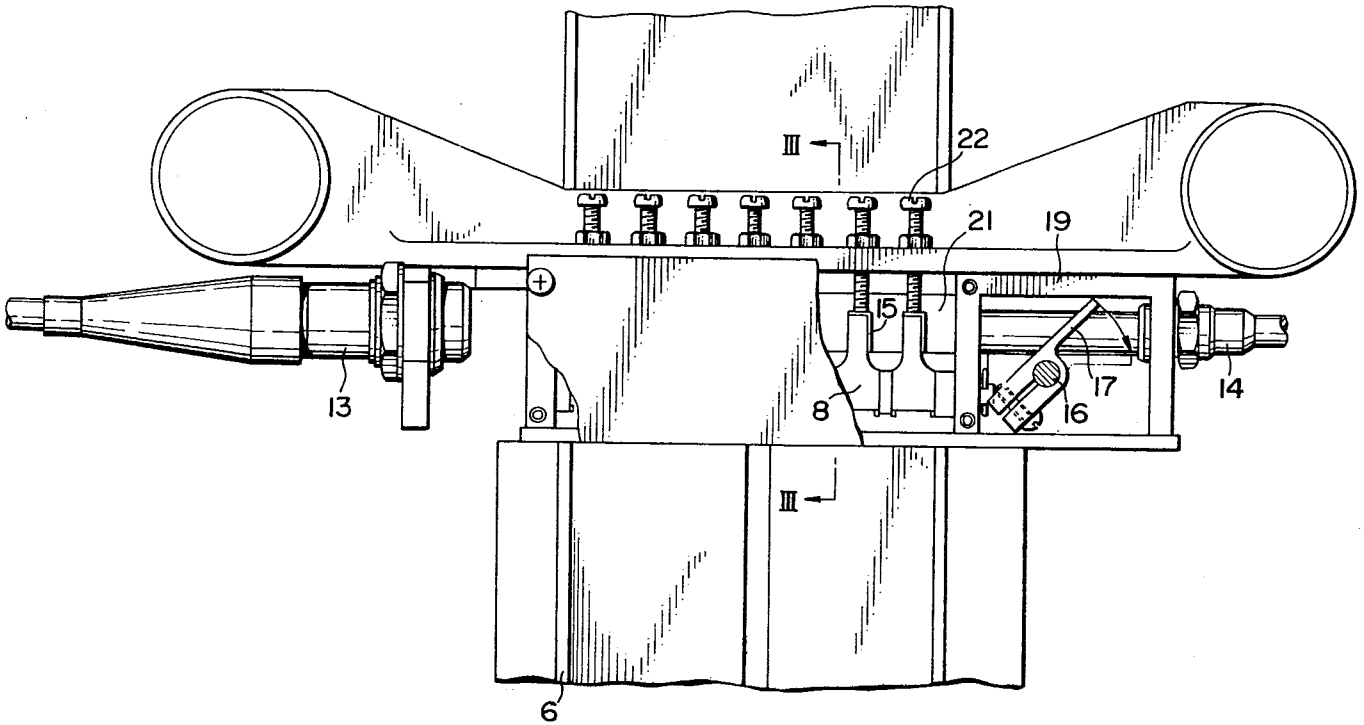
FIG. 1 is a partly sectioned plan view of an apparatus according to the present invention.
Figure 2:
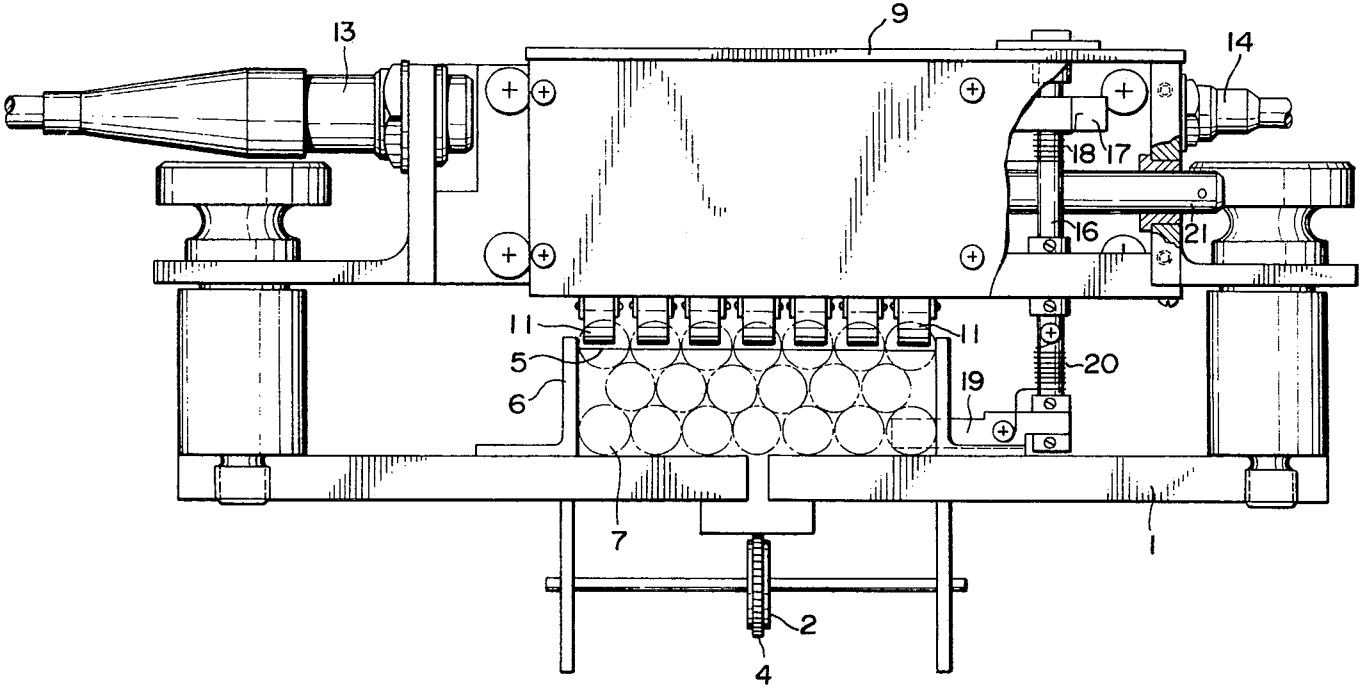
FIG. 2 is a partly sectioned elevation of the same.
Figure 3:
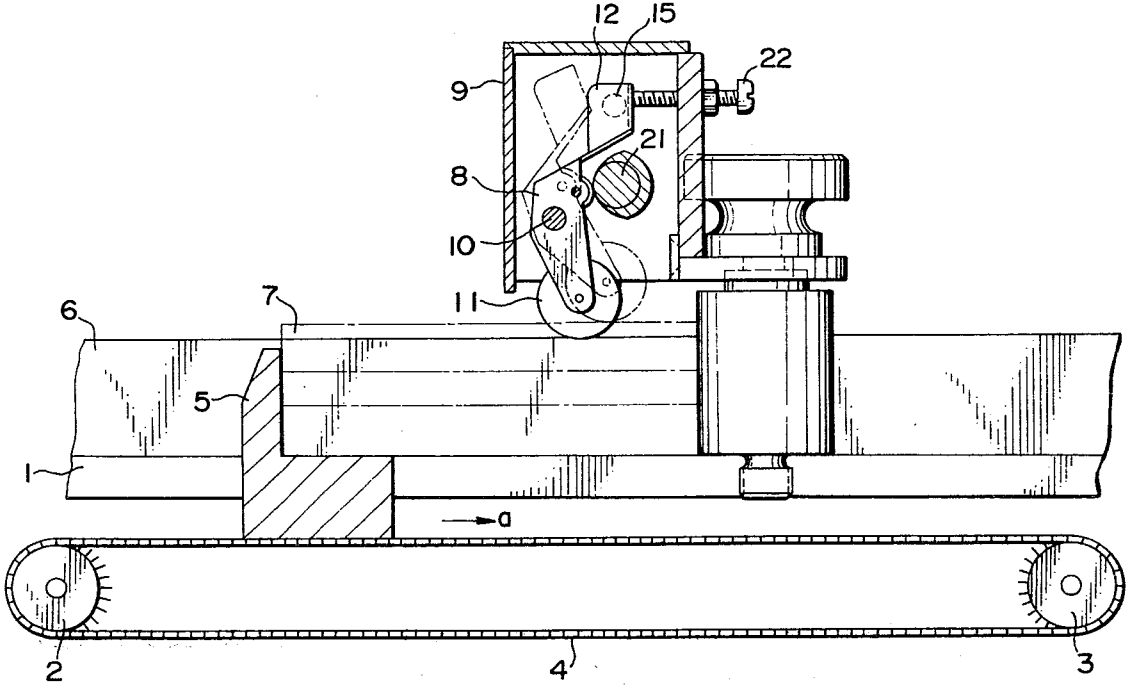
FIG. 3 is a sectioned view on line III—III in FIG. 1.

In the drawings, sprockets 2 and 3 are provided below a base 1, a chain 4 is stretched around them and a presser 5 fitted to the chain 4 is projected partly into a rectangular frame 6 formed on the upper surface of the base 1. Therefore, when, for example, 20 cigarets 7 are arranged so as to be in three steps of 7, 6 and 7 cigarets respectively from the upper step, the cigarets 7 will be moved from the left to the right in FIG. 3 by the presser 5 in the direction indicated by the arrow a with the running of the chain 4. A plurality of contact arms 8 (seven in the drawings) opposed to the moving passages of the cigarets are respectively independently rotatably borne on a shaft 10 arranged above and at right angles with the frame within a case 9. Each contact arm 8 is fitted with a roller 11 at the lower end and with a shielding plate 12 at the upper end. The roller 11 has a proper self-weight under which it is suspended. As the rollers 11 are so made as to properly contact the respective cigarets 7 arranged on the upper step, when the cigarets 7 are pressed by the presser 5 so as to pass below the rollers 11, the rollers 11 will rotate as shown by the chain line in FIG. 3 and will properly press the cigarets 7 with the self-weights of the rollers. On the other hand, shielding plates 12 are normally arranged in a line, a light projecting device 13 and a photoelectric converting device 14 provided with such light receiving element as a phototransistor are provided at the ends on both sides so that a fine beam may be projected in the direction incident upon the photoelectric converting device 14 across the shielding plates 12 through a small orifice made in the case 9. When the contact arms 8 rotate in contact with the cigarets 7, they will cross a light passage 15 (See FIG. 3) of the projected beam and the shielding plates 12 will open the light passage 15. Therefore, normally the light passage 15 will be intercepted by the shielding plates 12 and will not be incident upon the photoelectric converting device 14 and therefore said device 14 will send out no output signal. But, when a fixed number of cigarets as arranged pass below the rollers 11, the rollers 11 will rotate while in contact with the respective cigarets. Therefore, each shielding plate 12 will move from the light passage 15 so as to open it. On the other hand, a shielding plate 17 is secured also to a supporting shaft 16 borne on the case 9 so as to be rotated anticlockwise (as seen in FIG. 1) by a spring 18 and to stop in contact with the case 9 to intercept the above mentioned light passage 15. A sensing lever 19 is rotatably borne on the lower part of the supporting shaft 16 so as to be rotated clockwise by a spring 20, to be normally projected at right angles on the side of the lower step of the cigarets by a stopper (on the back side of the sensing lever 19 as seen in FIG. 2) fixed to the supporting shaft 16 and to itself rotate anticlockwise against a spring 20. Therefore, normally the light passage 15 will be intercepted by the shielding plate 17 but, when a fixed number of cigarets 7 are moved as arranged, the sending lever 19 will rotate clockwise against the spring 18 together with the supporting shaft 16 while in contact with the side of the cigarets 7 on the lower step and therefore the shielding plate 17 will rotate from the light passage 15 to open it as shown by the broken line. When the presser 5 is retreated for adjustment only the sensing lever 19 will rotate anticlockwise against the spring 20. In the drawings, 21 is a cam shaft to be manually rotates to hold the contact arms 8 as in the broken line in FIG. 3, fix the respective positions of the rollers 11 and adjust screws 22 so that the respective shielding plates 12 may operate simultaneously and the operation may be adjusted.

The operation of the thus formed present invention shall be described in the following.

Normally the beam form the light projecting device 13 will have the light passage 15 intercepted by the shielding plates 12 and 17 and will not be incident upon the photoelectric converting device 14 and therefore said device 14 will send out no output signal but, when the cigarets 7 as arranged as predetermined pass below the rollers 11, the rollers 11 will rotate in contact with the respective cigarets 7.

On the other hand, the sensing lever 19 on the lower step will also rotate in contact with the side of the cigarets 7, therefore the shielding plates 12 and 17 will move out of the light passage 15, the beam will be incident upon the photoelectric converting device 14 and a signal will be sent out of the device 14. However, in case the number of the arranged cigarets lacks, for example, when the cigarets on the upper step lack, there will be a contact arm producing no rotation and therefore the beam will be intercepted by the shielding plate of this contact arm. When the cigarets on the middle step lack, the cigaret on the upper step will drop onto the middle step, the beam will be intercepted by the contact arm not operating. Further, when the cigarets on the lower step lack, the sensing lever will push the side and will be therefore moved to one side, the shielding plate 17 will not operate and therefore the beam will be intercepted.

In case the number of cigarets lacks and one of them is diagonally arranged or is broken to be deformed, even if the beam is once incident upon the photoelectric converting device 14, it will be immediately intercepted. That is to say, the beam will not be incident upon the photoelectric converting device 14 continuously for a fixed time and therefore, by detecting the wave form of the output signal, the lack in the number of the cigarets and the mixing in a such defective cigaret as has become partly soft in the rolling will be able to be detected. Further, when a switch is engaged with the driving device of the chain 4 or the presser 5 or the like so that the detecting device may operate only in case the cigarets 7 are below the contact arms 8, the lack in the number of cigarets and the mixing of a defective cigaret will be able to be detected by sending out a detecting signal when the detecting device is operating and the output signal of the photoelectric converting device is intercepted.

As explained above, the apparatus of the present invention operates in response to the respective states of cigarets to be packed with a simple structure, therefore, no mis-operation is likely to be caused by any abnormal arrangement of cigarets, any lack in the number of cigarets can be positively detected and further any cigaret abnormal in the shape can be detected and prevented from being packed.

What is claimed is:

1. An apparatus for preventing defective packing of cigarets which comprises a frame provided on the upper surface of a base, a pressing means for moving a plurality of cigarets arranged on many steps so as to be packed in the lengthwise direction of the cigarets along said frame, a plurality of contact arms each fitted at the lower end with a roller corresponding to each cigaret on the uppermost step, supported independently rotatably on a shaft arranged at right angles with said frame and fitted at the upper end with a shielding means, a sensing lever which is pivoted at one end on a supporting shaft rotating against a spring on the side of the lower step of the cigarets and fitted with a shielding means near the upper end and which projects at right angles with the advancing direction of the cigarets and a pair of optical means provided to be arranged in line with each of said shielding means.

2. An apparatus for preventing defective packing of cigarets according to claim 1 wherein said pair of optical means comprise a light projecting device for projecting a beam and a photoelectric converting device upon which said beam is to be incident.

3. An apparatus for preventing defective packing of cigarets according to claim 1 wherein a cam is provided on a shaft parallel with the shaft of said contact arms so that, by the rotation of the shaft of said cam, the contact arms may rotated as engaged with the cam.

4. An apparatus for preventing defective packing of cigarets according to claim 1 wherein a screw to be screwed into the side wall of a case is provided to adjust the position of the shielding plate of each contact arm.

5. An apparatus for preventing defective packing of cigarets according to claim 1 wherein said sensing lever is pivoted on said supporting shaft through a spring energized in the advancing direction of the cigarettes and is held in a fixed position as engaged with a stopper fixed to said supporting shaft.

* * * * *